US006189175B1

(12) United States Patent
Priester

(10) Patent No.: US 6,189,175 B1
(45) Date of Patent: Feb. 20, 2001

(54) PRIVATE PARTS CLEANING SYSTEM

(76) Inventor: Katie Priester, 216-21 115th Ter., Cambria Heights, NY (US) 11411

( * ) Notice: Under 35 U.S.C. 154(b), the term of this patent shall be extended for 0 days.

(21) Appl. No.: 09/566,151

(22) Filed: May 5, 2000

(51) Int. Cl.[7] ..... A46B 5/02; A46B 7/04
(52) U.S. Cl. ..... 15/145; 15/176.1; 15/176.6
(58) Field of Search ..... 15/145, 176.1, 15/176.4, 176.5, 176.6

(56) References Cited

U.S. PATENT DOCUMENTS 1,567,507 * 12/1925 Howard .
3,019,447 2/1962 Sluz .
4,092,744 6/1978 Butol .

FOREIGN PATENT DOCUMENTS

1331222 * 5/1963 (FR) ..... 15/176.1
2035073 * 6/1980 (GB) ..... 15/176.4
48313 * 4/1940 (NL) ..... 15/145

* cited by examiner

*Primary Examiner*—Randall E. Chin
(74) *Attorney, Agent, or Firm*—Goldstein & Canino

(57) ABSTRACT

A private parts cleaning system including a plurality of cleaning attachments adapted for cleaning hard to reach areas of a user. The cleaning attachments each are defined by a rigid plate. The rigid plate has an upper end and a lower end. The upper end has a cleaning head secured thereto. The lower end has an inverted Y-shaped protrusion secured thereto and extending downwardly therefrom. An attachment clip is provided that is adapted for coupling with the plurality of cleaning attachments. The attachment clip includes an inverted Y-shaped channel dimensioned for slidably receiving the inverted Y-shaped protrusion of one of the cleaning attachments therein. A handle portion is provided that is adapted for removably coupling with the attachment clip.

6 Claims, 2 Drawing Sheets

PRIVATE PARTS CLEANING SYSTEM

BACKGROUND OF THE INVENTION

The present invention relates to a private parts cleaning system and more particularly pertains to allowing handicapped people and the elderly to clean hard to reach areas.

The use of sanitary cleaning devices is known in the prior art. More specifically, sanitary cleaning devices heretofore devised and utilized for the purpose of cleaning objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,019,447 to Sluz discloses a device capable of cleaning one's anus with a spray of water. U.S. Pat. No. 4,092,744 to Butoi discloses a washing device comprised of a water jet and brush capable of cleaning an individual's private parts.

While these devices fulfill their respective, particular objective and requirements, the aforementioned patents do not describe a private parts cleaning system for allowing handicapped people and the elderly to clean hard to reach areas.

In this respect, the private parts cleaning system according to the present invention substantially departs from the conventional concepts and designs of the prior art, and in doing so provides an apparatus primarily developed for the purpose of allowing handicapped people and the elderly to clean hard to reach areas.

Therefore, it can be appreciated that there exists a continuing need for a new and improved private parts cleaning system which can be used for allowing handicapped people and the elderly to clean hard to reach areas. In this regard, the present invention substantially fulfills this need.

SUMMARY OF THE INVENTION

In the view of the foregoing disadvantages inherent in the known types of sanitary cleaning devices now present in the prior art, the present invention provides an improved private parts cleaning system. As such, the general purpose of the present invention, which will be described subsequently in greater detail, is to provide a new and improved private parts cleaning system which has all the advantages of the prior art and none of the disadvantages.

To attain this, the present invention essentially comprises a plurality of cleaning attachments adapted for cleaning hard to reach areas of a user. The cleaning attachments each are defined by a rigid plate. The rigid plate has an upper end and a lower end. The upper end has a cleaning head secured thereto. The lower end has an inverted Y-shaped protrusion secured thereto and extending downwardly therefrom. An attachment clip is provided that is adapted for coupling with the plurality of cleaning attachments. The attachment clip includes an inverted Y-shaped channel dimensioned for slidably receiving the inverted Y-shaped protrusion of one of the cleaning attachments therein. The attachment clip includes a cylindrical collar extending downwardly therefrom. The cylindrical collar has an open lower end. A handle portion is provided that is adapted for removably coupling with the attachment clip. The handle portion has a tapered upper end dimensioned for being received within the open lower end of the cylindrical collar of the attachment clip. The handle portion has a lower end formed with hand gripping indentations.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved private parts cleaning system which has all the advantages of the prior art sanitary cleaning devices and none of the disadvantages.

It is another object of the present invention to provide a new and improved private parts cleaning system which may be easily and efficiently manufactured and marketed.

It is a further object of the present invention to provide a new and improved private parts cleaning system which is of durable and reliable construction.

An even further object of the present invention is to provide a new and improved private parts cleaning system which is susceptible of a low cost of manufacture with regard to both materials and labor, and which accordingly is then susceptible of low prices of sale to the consuming public, thereby making such a private parts cleaning system economically available to the buying public.

Even still another object of the present invention is to provide a new and improved private parts cleaning system for allowing handicapped people and the elderly to clean hard to reach areas.

Lastly, it is an object of the present invention to provide a new and improved private parts cleaning system including a plurality of cleaning attachments adapted for cleaning hard to reach areas of a user. The cleaning attachments each are defined by a rigid plate. The rigid plate has an upper end and a lower end. The upper end has a cleaning head secured thereto. The lower end has an inverted Y-shaped protrusion secured thereto and extending downwardly therefrom. An attachment clip is provided that is adapted for coupling with the plurality of cleaning attachments. The attachment clip includes an inverted Y-shaped channel dimensioned for slidably receiving the inverted Y-shaped protrusion of one of the cleaning attachments therein. A handle portion is provided that is adapted for removably coupling with the attachment clip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
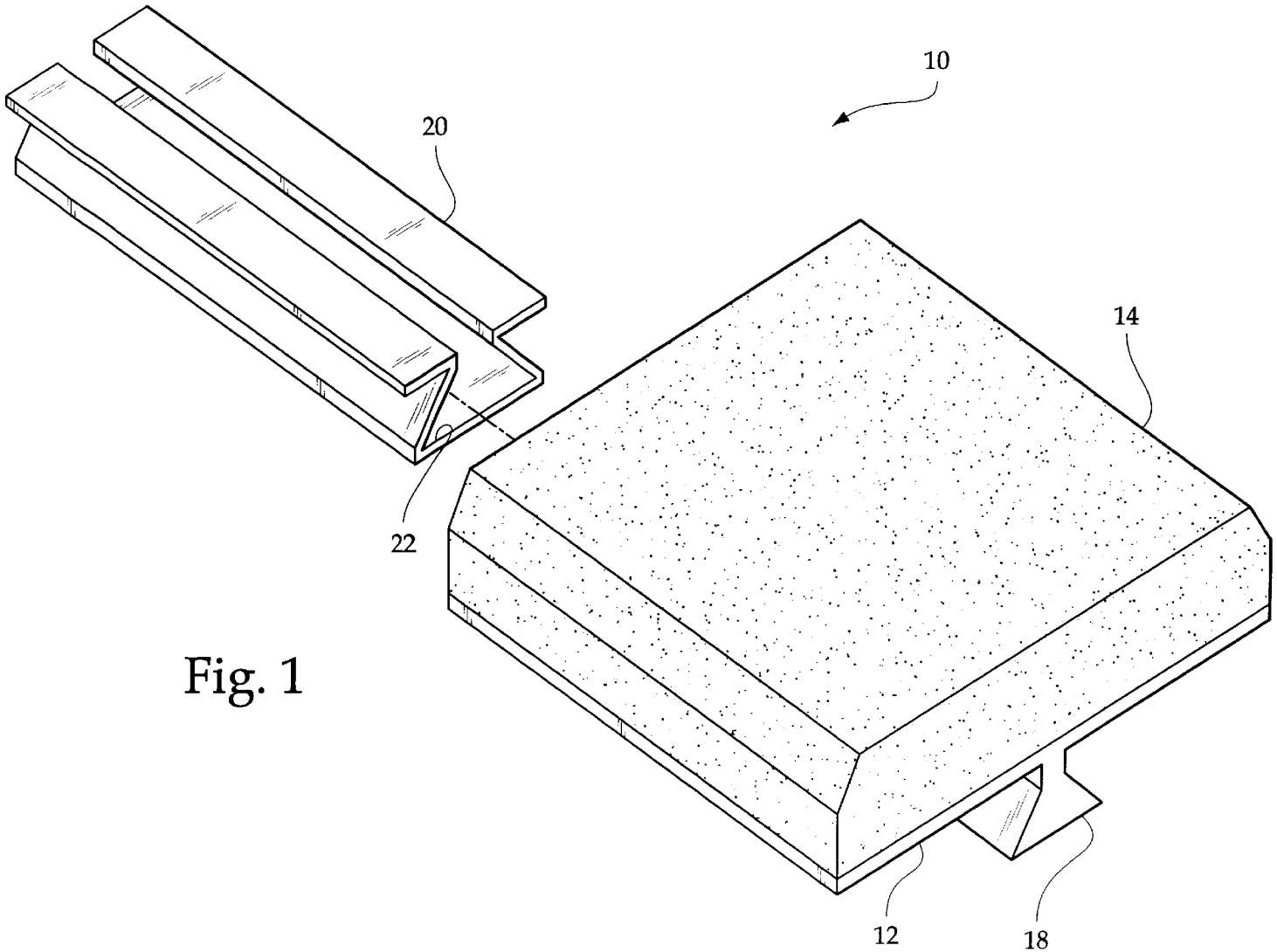
FIG. 1 is a perspective view of the preferred embodiment of the private parts cleaning system constructed in accordance with the principles of the present invention.
Figure 2:
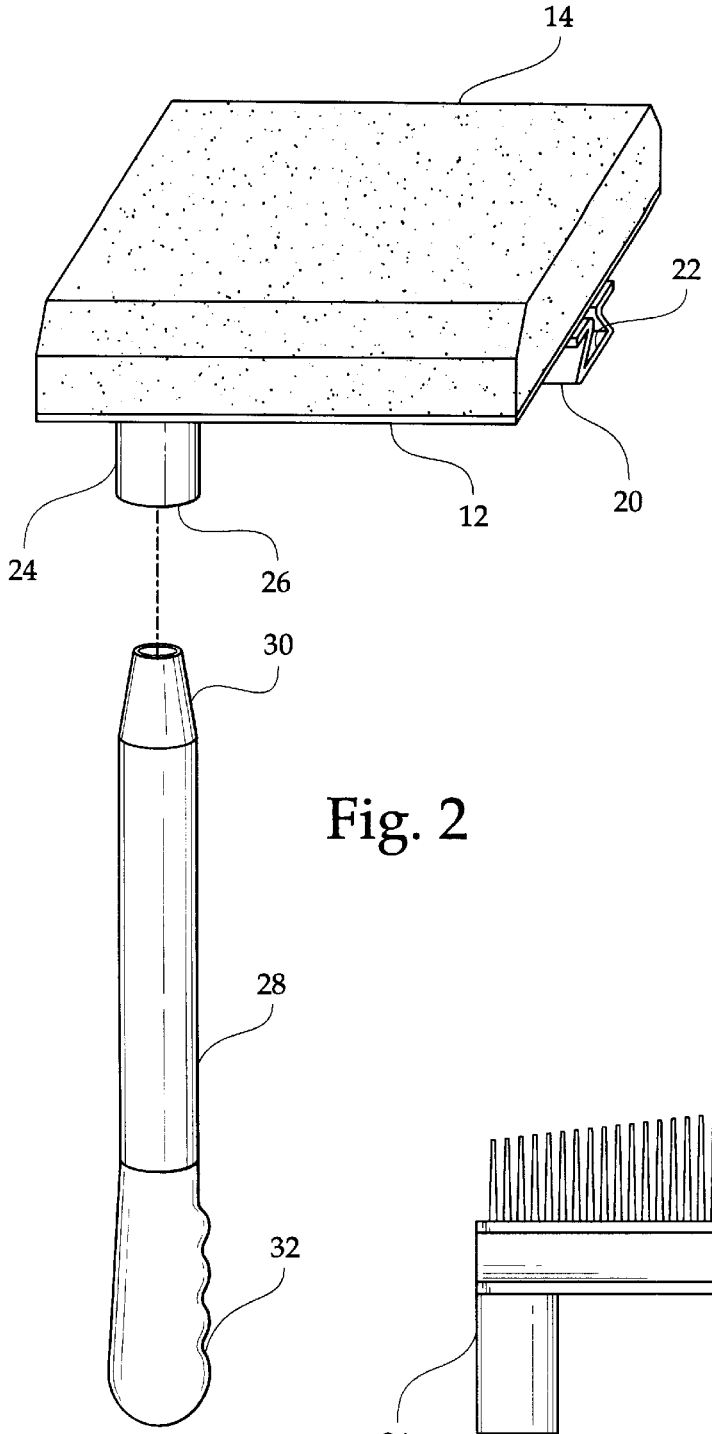
FIG. 2 is a perspective view of the present invention illustrating use of the handle.
Figure 3:
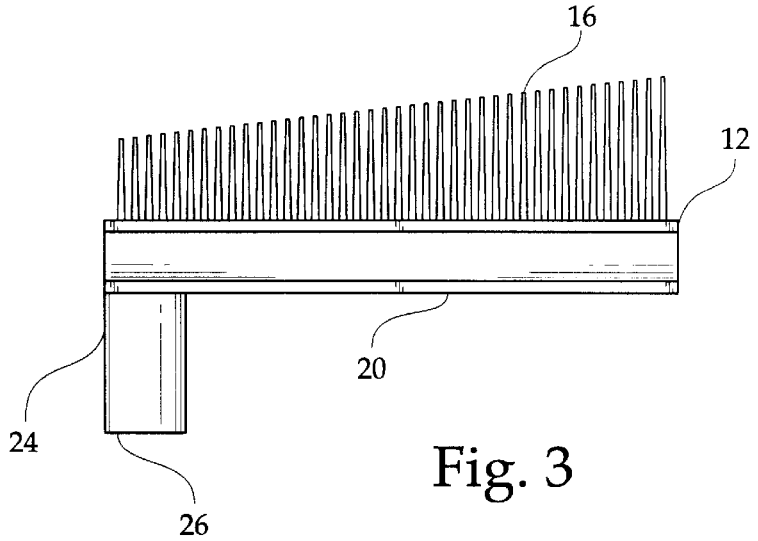
FIG. 3 is a side view of the washing brush of the present invention.

With reference now to the drawings, and in particular, to FIGS. 1 through 3 thereof, the preferred embodiment of the s new and improved private parts cleaning system embodying the principles and concepts of the present invention and generally designated by the reference number 10 will be described.

Specifically, it will be noted in the various Figures that the device relates to a private parts cleaning system for allowing handicapped people and the elderly to clean hard to reach areas. In its broadest context, the device consists of a plurality of cleaning attachments, an attachment clip, and a handle portion. Such components are individually configured and correlated with respect to each other so as to attain the desired objective.

The plurality of cleaning attachments are adapted for cleaning hard to reach areas of a user. The cleaning attachments each are defined by a rigid plate 12. The rigid plate 12 has an upper end and a lower end. The upper end has a cleaning head secured thereto. The cleaning heads preferably utilized are a washing sponge 14 (FIGS. 1 and 2) and a washing brush 16 (FIG. 3). The lower end has an inverted Y-shaped protrusion 18 secured thereto and extending downwardly therefrom.

The attachment clip 20 is adapted for coupling with the plurality of cleaning attachments. The attachment clip 20 includes an inverted Y-shaped channel 22 dimensioned for slidably receiving the inverted Y-shaped protrusion 18 of one of the cleaning attachments therein. The attachment clip 20 includes a cylindrical collar 24 extending downwardly therefrom. The cylindrical collar 24 has an open lower end 26.

The handle portion 28 is adapted for removably coupling with the attachment clip 20. The handle portion 28 has a tapered upper end 30 dimensioned for being received within the open lower end 26 of the cylindrical collar 24 of the attachment clip 20. The handle portion 28 has a lower end formed with hand gripping indentations 32. Alternately, the handle portion 28 could be telescopic to allow it's length to be adjusted to accommodate the specific need of the user.

In use, the user simply attaches the desired cleaning attachment to the attachment clip 20 and the handle portion 28 and maneuvers the handle portion 28 to effectively wash their private parts and other difficult to reach areas.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A private parts cleaning system for allowing handicapped people and the elderly to clean hard to reach areas comprising, in combination:

a plurality of cleaning attachments adapted for cleaning hard to reach areas of a user, the cleaning attachments each being defined by a rigid plate, the rigid plate having an upper end and a lower end, the upper end having a cleaning head secured thereto, the lower end having an inverted Y-shaped protrusion secured thereto and extending downwardly therefrom;

an attachment clip adapted for coupling with the plurality of cleaning attachments, the attachment clip including an inverted Y-shaped channel dimensioned for slidably receiving the inverted Y-shaped protrusion of one of the cleaning attachments therein, the attachment clip including a cylindrical collar extending downwardly therefrom, the cylindrical collar having an open lower end;

a handle portion adapted for removably coupling with the attachment clip, the handle portion having a tapered upper end dimensioned for being received within the open lower end of the cylindrical collar of the attachment clip, the handle portion having a lower end formed with hand gripping indentations.

2. The private parts cleaning system as set forth in claim 1 wherein the cleaning heads of the cleaning attachments include a washing sponge and a washing brush.

3. The private parts cleaning system as set forth in claim 2 wherein the washing sponge is replaceable.

4. A private parts cleaning system for allowing handicapped people and the elderly to clean hard to reach areas comprising, in combination:

a plurality of cleaning attachments adapted for cleaning hard to reach areas of a user, the cleaning attachments each being defined by a rigid plate, the rigid plate having an upper end and a lower end, the upper end having a cleaning head secured thereto, the lower end having an inverted Y-shaped protrusion secured thereto and extending downwardly therefrom;

an attachment clip adapted for coupling with the plurality of cleaning attachments, the attachment clip including an inverted Y-shaped channel dimensioned for slidably receiving the inverted Y-shaped protrusion of one of the cleaning attachments therein;

a handle portion adapted for removably coupling with the attachment clip.

5. The private parts cleaning system as set forth in claim 4 wherein the attachment clip includes a cylindrical collar extending downwardly therefrom, the cylindrical collar having an open lower end for receiving the handle portion therein.

6. The private parts cleaning system as set forth in claim 5 wherein the handle portion has a tapered upper end dimensioned for being received within the open lower end of the cylindrical collar of the attachment clip, the handle portion having a lower end formed with hand gripping indentations.

* * * * *